US011098714B2

(12) United States Patent
Bodrozic et al.

(10) Patent No.: US 11,098,714 B2
(45) Date of Patent: Aug. 24, 2021

(54) PUMP AND SYSTEM FOR SUPPLYING A CONSUMER

(71) Applicant: Magna Powertrain Bad Homburg GmbH, Bad Homburg (DE)

(72) Inventors: Ante Bodrozic, Frankfurt (DE); Karl Prinzhorn, Friedberg (DE); Christian Roll, Frankfurt (DE); Jan Schmid-Dallinger, Mainz (DE)

(73) Assignee: HANON SYSTEMS EFP DEUTSCHLAND GMBH, Bad Homburg (DE)

( * ) Notice: Subject to any disclaimer, the term of this patent is extended or adjusted under 35 U.S.C. 154(b) by 337 days.

(21) Appl. No.: 15/753,728

(22) PCT Filed: Jul. 13, 2016

(86) PCT No.: PCT/EP2016/066625
§ 371 (c)(1),
(2) Date: Feb. 20, 2018

(87) PCT Pub. No.: WO2017/032502
PCT Pub. Date: Mar. 2, 2017

(65) Prior Publication Data

US 2018/0180045 A1 Jun. 28, 2018

(30) Foreign Application Priority Data

Aug. 21, 2015 (DE) ..... 10 2015 215 982.5

(51) Int. Cl.
*F03C 2/00* (2006.01)
*F03C 4/00* (2006.01)
(Continued)

(52) U.S. Cl.
CPC ..... *F04C 15/066* (2013.01); *F01C 21/10* (2013.01); *F04C 2/3441* (2013.01); *F04C 11/00* (2013.01);
(Continued)

(58) Field of Classification Search
CPC .... F04C 2/3441; F04C 11/00; F04C 15/0023; F04C 15/0026; F04C 15/066;
(Continued)

(56) References Cited

U.S. PATENT DOCUMENTS 2,899,953 A * 8/1959 Morris ..... F02M 69/34 123/179.16
3,707,339 A * 12/1972 Budgen ..... F04C 29/021 418/13
(Continued)

FOREIGN PATENT DOCUMENTS

DE 2835816 A1 2/1980
DE 10259894 A1 7/2003
(Continued)

OTHER PUBLICATIONS

International Search Report and Written Opinion dated Nov. 21, 2016 from International Patent Application Serial No. PCT/EP2016/066625, with English translation of International Search Report.
(Continued)

*Primary Examiner* — Theresa Trieu
(74) *Attorney, Agent, or Firm* — Dickinson Wright PLLC

(57) ABSTRACT

The invention relates to a pump, having a contour ring, having a rotor, having vanes, having side plates, having a housing and a housing cover, having under-vane grooves for supplying the lower vane faces with pressure, the vanes being arranged radially displaceably in the rotor and extending under the vanes as a result of the pressure and being
(Continued)

pressed against the contour ring. Furthermore, the invention relates to a system for supplying oil to a consumer.

10 Claims, 3 Drawing Sheets

(51) Int. Cl.

| | |
|---|---|
| ***F04C 2/00*** | (2006.01) |
| ***F04C 18/00*** | (2006.01) |
| ***F04C 15/06*** | (2006.01) |
| ***F04C 2/344*** | (2006.01) |
| ***F04C 15/00*** | (2006.01) |
| ***F01C 21/10*** | (2006.01) |
| ***F04C 11/00*** | (2006.01) |

(52) U.S. Cl.
CPC ..... *F04C 15/0023* (2013.01); *F04C 15/0026* (2013.01); *F04C 2210/206* (2013.01); *F04C 2240/10* (2013.01); *F04C 2240/30* (2013.01); *F04C 2240/811* (2013.01); *F04C 2270/701* (2013.01)

(58) Field of Classification Search
CPC ..... F04C 2210/206; F04C 2240/10; F04C 2240/30; F04C 2240/811; F04C 2270/701; F01C 21/10
USPC ..... 418/131, 133, 135, 259, 266–268
See application file for complete search history.

(56) References Cited

U.S. PATENT DOCUMENTS

| | | | | |
|---|---|---|---|---|
| 5,807,090 | A * | 9/1998 | Agner | F04C 15/0023 418/135 |
| 6,485,277 | B2 * | 11/2002 | Agner | F01C 21/18 418/183 |
| 9,593,681 | B2 * | 3/2017 | Bohm | F04C 2/3446 418/268 |
| 2005/0254981 | A1 * | 11/2005 | Liepert | F04C 23/001 418/5 |
| 2014/0158467 | A1 | 6/2014 | Kimura et al. | |
| 2015/0010419 | A1 * | 1/2015 | Holtmann | F04C 15/0026 418/135 |

FOREIGN PATENT DOCUMENTS

| | | | |
|---|---|---|---|
| DE | 102014212022 | A1 | 1/2015 |
| DE | 102014222321 | B3 | 12/2015 |
| EP | 0758716 | B1 | 12/2003 |
| EP | 1992846 | A1 | 11/2008 |
| JP | 2011058640 | A | 3/2011 |
| WO | WO2009121471 | A1 | 10/2009 |
| WO | WO2013064386 | A2 | 5/2013 |

OTHER PUBLICATIONS

Search Report dated Jun. 30, 2016 from German Patent Application No. 102015215982.5.

* cited by examiner

PUMP AND SYSTEM FOR SUPPLYING A CONSUMER

CROSS-REFERENCE TO RELATED APPLICATIONS

This application is a National Stage of International Application No. PCT/EP2016/066625, filed Jul. 13, 2016, which claims priority to DE 102015215982.5 filed Aug. 21, 2015. The entire disclosures of each of the above applications are incorporated herein by reference.

FIELD OF THE INVENTION

The invention relates to a pump, having a contour ring, having a rotor, having vanes, having side plates, having a housing and a housing cover, having under-vane grooves for supplying the lower vane faces with pressure, the vanes being arranged radially displaceably in the rotor and extending under the vanes as a result of the pressure and being pressed against the contour ring.

Furthermore, the invention relates to a system for supplying oil to a consumer.

BACKGROUND OF THE INVENTION

This section provides background information related to the present disclosure which is not necessarily prior art.

Pumps of this type are known and are used, in particular, for supplying power steering systems or similar hydraulic systems in motor vehicles, and as a gear pump, for example in an automatic transmission. Here, the two pressure chambers of the vane cells are connected to one another, for example, via a pressure collecting space inside or outside the pump, which pressure collecting space leads in a common pressure line to the consumer. The two suction chambers of the vane cells are likewise connected to one another and lead to the intake region of the pump, in which intake region the oil which flows out of the steering system or a tank is fed to the pump again.

A pump of this type is described in principle in FIGS. 2 and 3 and comprises a cam ring 3 which has an axial recess 5, in which a rotor 7 is situated such that it can be rotated relative to the cam ring 3. Said rotor 7 has slots, in which vanes 10 are received such that they can be moved radially. Along its circumference, the axial recess 5 has an inner wall with a contour, on which the vanes 10 run during a rotation of the rotor 7. Here, the contour is configured in such a way that each conveying element is extended to a greater or lesser extent out of the radial recess, in which it is received, in a manner which is dependent on its rotational relative position to the cam ring. As a result, conveying cells which are delimited by adjacent conveying elements and the inner wall are configured. The volume of a conveying cell of this type changes periodically with the rotation of the rotor relative to the cam ring. In this way, at least one suction region and at least one pressure region of the pump are defined, the suction region being arranged in a region, in which the volume of the conveying cells increases with the revolution of the rotor. The pressure region is arranged in a region, in which the volume of the conveying cells decreases with a rotation of the rotor. It is possible that the pump comprises two pump sections which in each case have a suction region and a pressure region. This is then what is known as a double action pump. Furthermore, the pump 1 has a side plate 13 which closes off the axial recess on a first side and a pressure plate 17 which closes off the axial recess on a second side. Here, the side plate 13 and the pressure plate 17 likewise delimit the conveying cells. The pressure plate 17 has at least one opening, by way of which the at least one pressure region of the pump is connected fluidically to an outer surrounding area of the pressure plate, in particular what is known as a pressure space 16. Overall, therefore, the pump conveys a fluid from a suction space which is connected fluidically to the suction region via suction kidneys 40 into the pressure space via pressure kidneys 41. The suction space is connected fluidically to a supply tank via a pump inlet 11. The pressure space 16 is connected fluidically to a consumer 6.

At a standstill of the pump, depending on the arrangement thereof, some vanes retract into the recesses which are assigned to them on account of the gravitational force which acts on them. They then no longer bear against a wall of the cam ring 3, which wall defines the inner contour. When the pump starts up again, the corresponding vanes cannot therefore contribute to the delivery of the fluid as long as they have not been extended from their recesses on account of the centrifugal force and/or as a result of fluid pressure assistance. In order to increase the pressing force of the vanes against the inner wall of the cam ring, a fluid path is provided from the at least one pressure region of the pump into what is known as an under-vane region 39 of the vanes. Said region is arranged radially within the vanes and comprises regions of the radial recesses of the rotor, which regions are arranged radially behind the vanes, that is to say closer to a rotational axis of the pump than the latter.

Pressurized fluid which is conveyed by the pump is thus guided out of the pressure region into the under-vane region and supports the vanes by increasing the pressing force which acts on them against the inner wall of the cam ring.

During cold starting of the pump, it occurs that the pump first of all starts with a delay as a result of idling of the pump and as a result of highly viscous operating media, and requires high rotational speeds before it reaches the desired conveying result.

In order to improve the properties of the pump during starting up, a cold starting plate 31 is provided which is prestressed by means of a spring element 33 against the pressure plate 17 in such a way that, at least at a standstill of the pump, it closes the at least one opening in the pressure plate with respect to its external surroundings. There is then no fluidic connection from the pressure region to the pressure space 16. All the fluid which is conveyed by the pump during starting up of the latter therefore passes from the pressure region via the fluid path into the under-vane region, with the result that the conveyed fluid is first of all used completely to extend the vanes out of their recesses and to press them against the inner wall of the cam ring 3. When the pump has been moved into a fully functional state as a result, the conveying pressure in the pressure region increases, as a result of which the cold starting plate 31 is pressed away from the pressure plate 17 counter to the prestressing force of the spring element 33. As a result, the fluidic connection between the pressure region and the pressure space is released, and the pump conveys fluid from the suction space into the pressure space 16.

A pump with a corresponding supply of an under-vane region and a cold starting plate is apparent from EP 0 758 716 B1.

Various consumers, such as a double clutch transmission, are provided with an engine-driven main pump and an electric additional oil pump. Both pumps are connected to the consumer and are selectively operated individually or together. In order to prevent that oil leaks through the non-operated pump in in each case pumping operation of the pump or the additional pump, the connections of both pumps to the consumer are provided with check valves.

An embodiment of this type for a transmission is known from US20140158467. First and second check valves are installed into the supply line.

The specification of preventing the leakage oil flow requires separate valves both for the main pump and for the additional pump, which is expensive and increases the installation space which is required. The outlay for an automotive manufacturer is therefore greater, since it will have to provide a valve, for example a spring-loaded ball valve in the feed line itself.

WO 20130643868 A2 has disclosed a double action vane cell pump having a housing. In said embodiment, check valves are accommodated in the housing of the pump. Said check valves are not, however, connected via the main pressure connector of the pump. Furthermore, there is no auxiliary pump, the connection of which to the main pressure connector has to be regulated via a check valve.

DE 2835816 A1 has disclosed a pump having a cold starting pressure plate. There is no additional pump here either, and therefore no necessity to connect said additional pump via a check valve.

DE 10259894 A1 has disclosed a pump which produces the under-vane pressure by way of separation of under-vane grooves between the suction region and the pressure region. These are not a main pump and an additional pump. The main pressure connector is not connected directly to the pressure space of the pump, since the pressure ducts of the pump are connected to the outlet via check valves.

WO2009121471 A1 has disclosed a vane cell pump having a cold starting plate. Said pump does not have an integrated check valve, however, since said pump is not connected to an additional pump either.

SUMMARY OF THE INVENTION

This section provides a general summary of the disclosure, and is not a comprehensive disclosure of its full scope of all of its features.

The invention is based on the object of providing a pump which is connected to an additional pump and manages without an additional second valve for the main pump, and already integrates a valve for the additional pump for the end customer.

The object is achieved by way of the features of a pump in a housing having a cam ring which has an axial recess, a rotor which is received in the axial recess such that it can be rotated relative to the cam ring, the rotor having slots, in which vanes are received such that they can be moved in the radial direction, having a side plate which closes off the axial recess on a first side, having a pressure plate which closes off the axial recess on a second side, the pressure plate having at least one opening, and having a cold starting plate which is prestressed by means of a spring element against the pressure plate in such a way that, at least at a standstill of the pump, it closes the at least one opening in the pressure plate with respect to the external surroundings thereof, the housing of the pump having a main pressure connector to the consumer, the main pressure connector in the housing being connected directly to the pressure space of the pump and via a check valve to an additional pump.

In order to improve the integration, it is necessary that the check valve of the additional pump is installed in the housing.

The system for supplying oil to a consumer is realized in a particularly simple and inexpensive way by way of a pump according to the invention as a main pump and by way of an additional pump.

One valve is dispensed with and the required installation space can be reduced by virtue of the fact that no check valve is arranged between the main pressure outlet of the pump on the housing and the consumer.

The system is distinguished by the fact that the two check valves are the cold starting plate and a check valve which is integrated into the housing.

Further areas of applicability will become apparent from the description provided herein. The description and specific examples in this summary are intended for purposes of illustration only and are not intended to limit the scope of the present disclosure.

DESCRIPTION OF THE DRAWINGS

The drawings described herein are for illustrative purposes only of selected embodiments and not all possible implementations, and are not intended to limit the scope of the present disclosure.

The invention will now be described in greater detail using the figures, in which.

Figure 1:
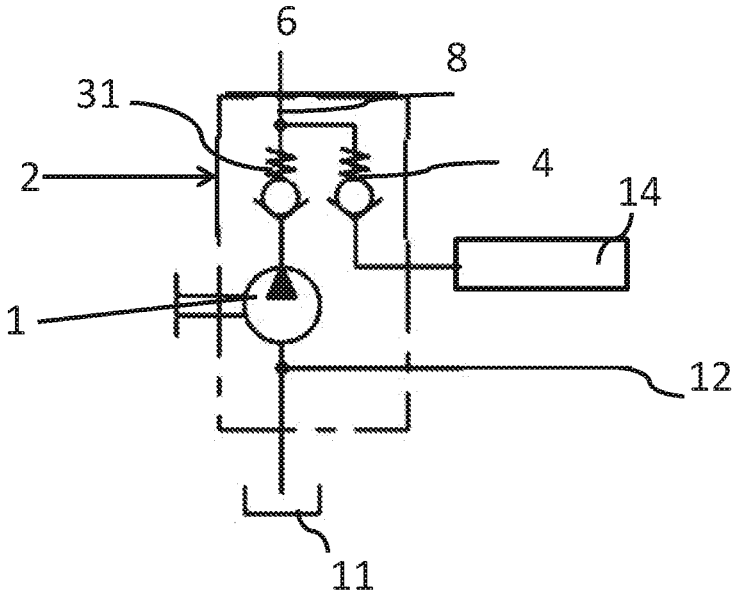
FIG. 1 shows a hydraulic circuit diagram according to the invention.

The solution according to the invention and the system according to the invention can be understood using FIG. 1. A pump 1 is indicated diagrammatically. It is connected to a pump inlet 11 which is connected to the suction side of the pump. On the pressure side, the pump is provided with a check valve function which is provided between the pump and a main pressure connector 8 to a consumer 6. An additional pump 14 is connected via a check valve 4 to the main pressure connector 8. According to the invention, the check valve function of the pump 1 is realized at least by way of a cold starting plate 31. The pump 1 and the two check valves are situated in a common housing 2.

As a result of the use of an existing cold starting device additionally as a check valve, no further components for sealing the main pressure connector 8 of the main pump are necessary.

Figure 2:
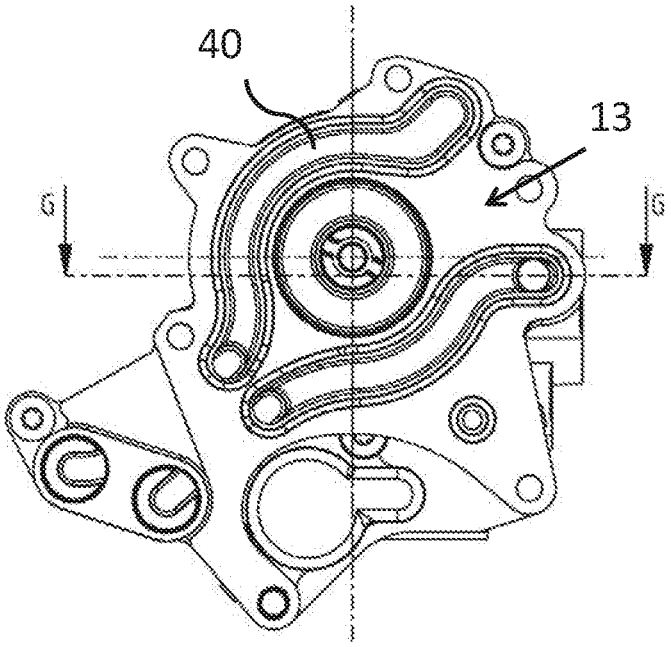
FIG. 2 shows a side plate of the pump.

FIG. 2 shows a view of the side plate 13 of the pump. The suction kidneys 40 are connected to the pressure space of the pump.

Figure 4:
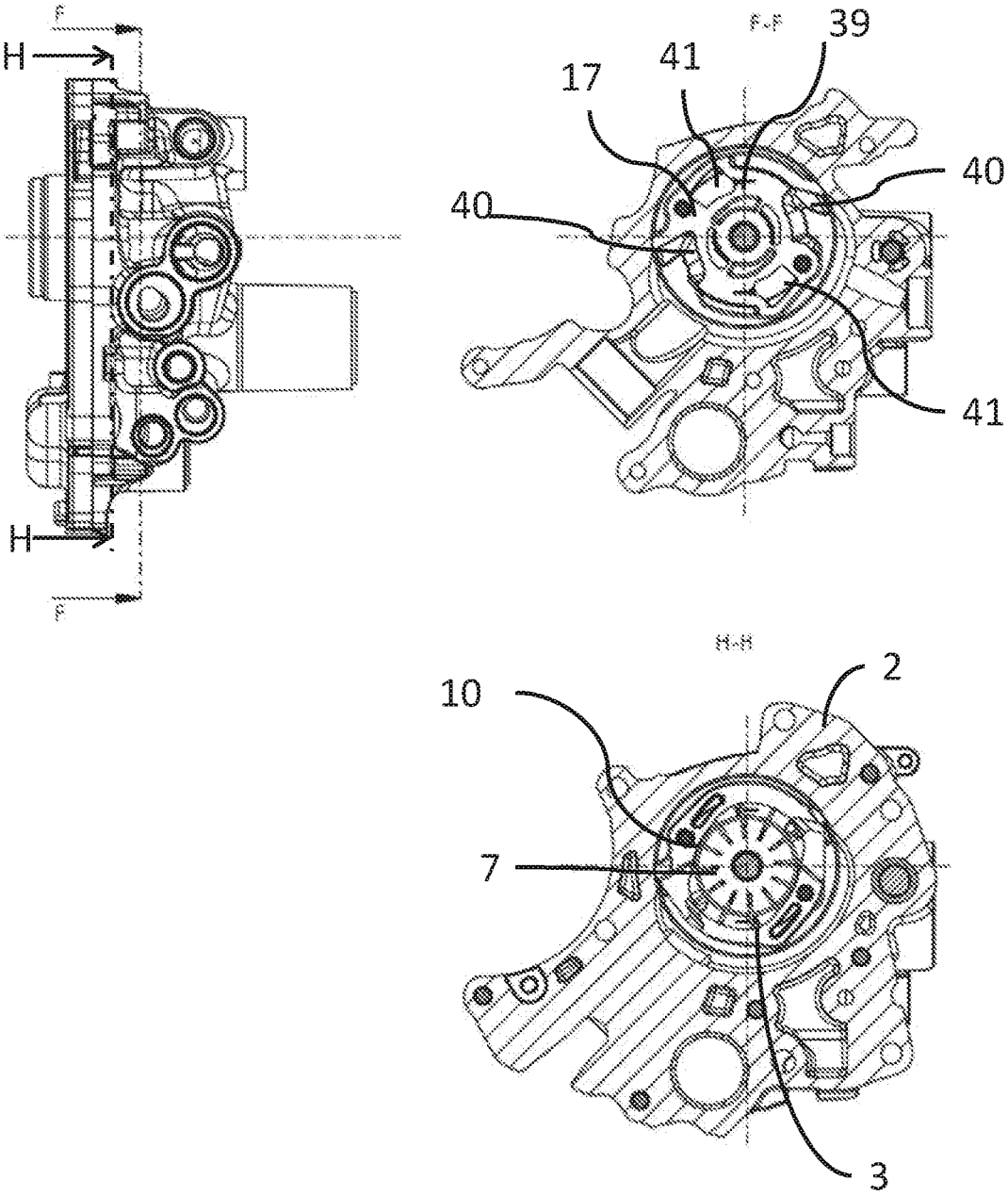
FIG. 4 shows sections through the pressure plate (F-F) and through the inner parts (H-H).

A sectional image of the pump 1 which is shown in the region of the under-vane plane F-F of the pressure plate 17 can be seen in FIG. 4. The suction kidneys 40 and the pressure kidneys 41 can be seen.

Figure 3:
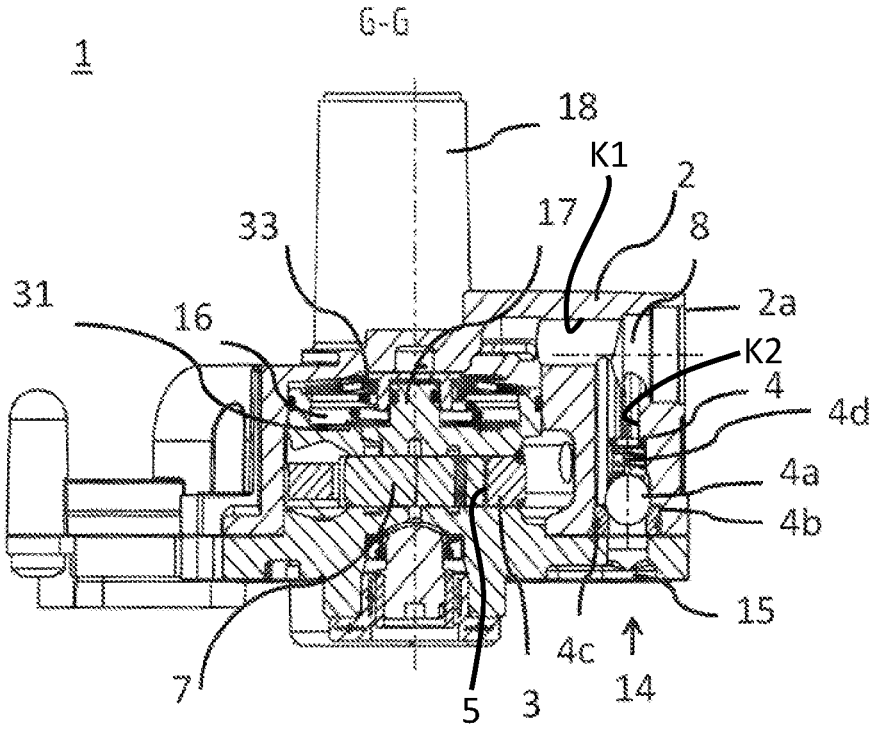
FIG. 3 shows a section along the rotational axis of the pump G-G.

FIG. 3 shows the section along the plane G-G from FIG. 2. The pump which is otherwise of conventional construction has a housing 2 which has a plurality of connectors 18 for the inlet and outlet. The pump is delimited by side plates 13 and a working space, the side plates and the working space being combined to form a housing 2. On the right-hand side, the pump has a thickened housing part 2*a* which contains the bores or recesses for the main pressure connector 8 and the check valve 4 of the additional pump connector. Here, a main pressure outlet duct K1 is formed with a greater cross section than the additional pump duct K2.

The main pressure connector 8 is connected to the pressure space 16. The duct K2 and the receptacle for the pressure connector of the additional pump 15 run perpendicularly with respect to the course of said main pressure connector 8. As an example of an integrated check valve, a spring-loaded ball valve is used which consists of a ball 4*a* in a valve seat 4*b* and a spring 4*d*. The valve seat 4*b* is sealed against the housing 2 by way of an O-ring 4*c*.

The two bores or recesses, the ducts K1 and K2 for the main pressure connector 8, and the check valve 4 do not have to be configured perpendicularly with respect to one another. It is sufficient if the recess for the check valve 4 of the additional pump is connected directly to the main pressure connector 8, which can also be achieved via a flow duct. The main pressure connector 8 is the common pressure connector of the two pumps, which common pressure connector leads to the consumer.

The system according to the invention having a main pump and an additional pump has a simple sealing means by way of the cold starting plate during operation with the additional oil pump. Here, the spring collar of the cold starting plate seals the pressure outlet of the main pump by means of a compression spring. As a result, the leakage path through the main pump is interrupted.

The spring collar of the cold starting plate opens only when the main pump starts operating. The check valve 4 closes the additional pump pressure connector 15 in the case where only the main pump is delivering. As a result, the leakage path through the additional oil pump is interrupted.

| List of Designations | |
|---|---|
| 1 | Pump |
| 2 | Housing |
| 2a | Housing part |
| 3 | Cam ring |
| 4 | Check valve |
| 4a | Ball |
| 4b | Valve seat |
| 4c | O-ring |
| 4d | Spring |
| 5 | Recess |
| 6 | Consumer |
| 7 | Rotor |
| 8 | Main pressure connector |
| 9 | Slot |
| 10 | Vane |
| 11 | Pump inlet |
| 12 | Oil return line |
| 13 | Side plate |
| 14 | Additional pump |
| 15 | Pressure connector, additional pump |
| 16 | Pressure space |
| 17 | Pressure plate |
| 18 | Connector |
| 31 | Cold starting plate |
| 33 | Shaped spring |
| 39 | Under-vane groove |
| 40 | Suction kidney |
| 41 | Pressure kidney |
| K1 Duct, main pressure outlet | |
| K2 Duct, additional pump | |

The invention claimed is:

1. A pump, comprising:

a housing;

a cam ring located in the housing and having an axial recess extending along an axis;

a rotor received in the axial recess and rotatable relative to the cam ring, the rotor having slots in which vanes are received and which are radially moveable relative to the rotor in the slots;

a side plate closing off the axial recess on a first side;

a pressure plate closing off the axial recess on a second side, the pressure plate having at least one opening; and a cold starting plate prestressed against the pressure plate by means of a spring element in such a way that, at least at a standstill of the pump, it closes the at least one opening in the pressure plate with respect to external surroundings;

wherein the housing has a main pressure connector for connecting the housing to a consumer, the main pressure connector being fluidly connected to a pressure space in the housing, wherein the housing also includes a check valve installed in the housing between the main pressure connector and an additional connector for an additional pump;

wherein the housing presents a thickened part along a lateral side of the rotor, wherein the thickened part defines a main pressure outlet duct defining the main pressure connector, and a additional pump duct extending from the main pressure outlet duct and defining the additional connecter and containing the check valve.

2. The pump as claimed in claim 1, wherein the check valve is not arranged to close the main pressure outlet duct.

3. The pump as claimed in claim 1, wherein the main pressure connector is a common pressure outlet of the pump and the additional pump.

4. The pump as claimed in claim 1, wherein the additional pump duct extends perpendicularly to the main pressure outlet duct.

5. The pump as claimed in claim 4, wherein the main pressure outlet duct extends radially relative to the axis, and wherein the additional pump duct extends axially.

6. A system for supplying oil to a consumer, including:

a housing;

a main pump located in the housing having:

a cam ring having an axial recess extending along an axis;

a rotor received in the axial recess and rotatable relative to the cam ring, the rotor having slots in which vanes are received and which are radially moveable relative to the rotor in the slots;

a side plate closing off the axial recess on a first side;

a pressure plate closing off the axial recess on a second side, the pressure plate having at least one opening; and a cold starting plate prestressed against the pressure plate by means of a spring element in such a way that, at least at a standstill of the main pump, it closes the at least one opening in the pressure plate with respect to external surroundings;

wherein the housing has a main pressure connector for connecting the housing to a consumer, the main pressure connector being fluidly connected to a pressure space of the main pump, wherein the housing also includes a check valve installed in the housing between the main pressure connector and an additional connector for an additional pump;

wherein the housing presents a thickened part along a lateral side of the rotor, wherein the thickened part defines a main pressure outlet duct defining the main connector, and a additional pump duct extending from the main pressure outlet duct and defining the additional connector and containing the check valve.

7. The system as claimed in claim 6, wherein the check valve is not arranged to close the main pressure outlet duct.

8. The system as claimed in claim 6, wherein the main pressure connector is a common pressure outlet of the main pump and the additional pump.

9. The system as claimed in claim 6, wherein the additional pump duct extends perpendicularly to the main pressure outlet duct.

10. The system as claimed in claim 9, wherein the main pressure outlet duct extends radially relative to the axis, and wherein the additional pump duct extends axially.

* * * * *